US007399258B1

(12) United States Patent
Sugar et al.

(10) Patent No.: US 7,399,258 B1
(45) Date of Patent: Jul. 15, 2008

(54) OMNI-DIRECTIONAL TREADMILL

(76) Inventors: Thomas G. Sugar, 750 W. Baseline Rd. #3149, Tempe, AZ (US) 85283; Kurt Bauernfeind, Siedlerweg 10, Bludesch (AT) 6719

( * ) Notice: Subject to any disclaimer, the term of this patent is extended or adjusted under 35 U.S.C. 154(b) by 637 days.

(21) Appl. No.: 10/301,382

(22) Filed: Nov. 20, 2002

Related U.S. Application Data

(60) Provisional application No. 60/332,440, filed on Nov. 20, 2001, provisional application No. 60/357,221, filed on Feb. 14, 2002.

(51) Int. Cl.
*A63B 22/00* (2006.01)
*A63B 21/00* (2006.01)

(52) U.S. Cl. ..... 482/54; 482/51

(58) Field of Classification Search ..... 482/51, 482/54; 119/700
See application file for complete search history.

(56) References Cited

U.S. PATENT DOCUMENTS 4,892,305 A * 1/1990 Lynch ..... 482/132
5,238,099 A 8/1993 Schroeder et al.
5,374,879 A 12/1994 Pin et al.
5,562,572 A 10/1996 Carmein
5,580,249 A 12/1996 Jacobsen et al.
5,590,605 A 1/1997 Salter et al.
5,739,657 A 4/1998 Takayama et al.
5,913,684 A 6/1999 Latham et al.
5,924,512 A 7/1999 Wada
5,927,423 A 7/1999 Wada et al.
5,980,256 A 11/1999 Carmein
6,050,822 A 4/2000 Faughn
6,123,647 A 9/2000 Mitchell
6,131,075 A 10/2000 Tai et al.
6,134,486 A 10/2000 Kanayama
6,152,854 A 11/2000 Carmein

OTHER PUBLICATIONS

Internet papers: Computer Graphics System Development Corporation, CGSD Products, http://www.cgsd.com, (printed) Aug. 25, 2003, 1 page.
Internet Papers: Sarcos, http://www.sarcos.com, (printed) Aug. 25, 2003, 1 page.
Internet Papers: US Devices, Inc., http://www.usdevices.com, (printed) Aug. 25, 2003, 1 page.

* cited by examiner

*Primary Examiner*—Glenn E. Richman
(74) *Attorney, Agent, or Firm*—Connolly Bove Lodge & Hutz LLP

(57) ABSTRACT

Treadmills are generally discussed herein with specific discussion to Omni-directional treadmills that incorporate powered offset casters to move a belt in the X, Y, and theta directions. The belt is positioned over a frame and the frame includes a plurality of rollers for allowing the belt to turn about the frame. The powered offset casters can be mounted under the belt or on top of the belt and are controlled by a control system, which controls the translational motion and rotational motion of the belt.

9 Claims, 10 Drawing Sheets

OMNI-DIRECTIONAL TREADMILL

CROSS-REFERENCE TO RELATED APPLICATIONS

Priority is claimed to provisional application Ser. No. 60/332,440, filed on Nov. 20, 2001, entitled OMNI-DIRECTIONAL TREADMILL, and to provisional application Ser. No. 60/357,221, filed on Feb. 14, 2002, entitled OMNI-DIRECTIONAL TREADMILL. The contents of these applications are expressly incorporated herein by reference as if set forth in full.

Treadmills are generally discussed herein with specific discussion to Omni-directional treadmills that incorporate powered offset casters to move a belt in the X, Y, and theta directions.

BACKGROUND

An Omni-directional treadmill (ODT) that allows a user to traverse in the X, Y, and theta directions has been described as the Holy Grail for virtual reality systems. Among other things, the ODT can function as a walking simulator when used in combination with virtual reality environments for activities such as gaming, military simulations, or evacuation simulations. Other examples of where an ODT may be used include laboratories for human motion studies, in perceptual studies for psychology experiments, in a gym as indoor exercise equipment, as language immersion systems, and as conveyors for manufacturing, just to provide some examples.

The company Virtual Space Devices, Inc. has an existing commercial ODT product. However, the available model only allows the user to move in two directions. The Virtual Space ODT uses a regular treadmill that includes 3400 rollers in the lateral direction to allow the user to slip sideways, and to move in two directions. However, the Virtual Space ODT is very complicated, noisy, and does not allow for natural movements. For example, the sideways motion feels icy, and the user has to wear a harness in case he or she slips.

The Virtual Reality Laboratory at University of Tsukuba developed an ODT called the Torus treadmill. The Torus treadmill uses a torus-shaped surface to build the locomotion interface. This treadmill consists of ten normal belt conveyers, which are connected side by side and driven in a perpendicular direction to simulate an infinite surface. The position of the walker is fixed in the real world by computer-controlled motion of the conveyers. This product requires many motors, and the motion of the user must be sensed using a vision system.

The US Army is funding the development of a locomotion simulator called the OmniTrek™, which allows motion in two directions as well as stair climbing. It is a complex device that involves two servo controlled robot arms to catch the user's feet. Another ODT is the Sarcos Treadport™, which was developed in 1995 and is based on the standard one-directional treadmill. The user of the Sacros Treadport™ must be monitored and constrained by a mechanical attachment to the user's waist. The user can walk, jog, and kneel, and the incline of the treadmill can be adjusted to simulate hills. However, the physical movement is constrained to one direction.

Other inventions include a giant sphere to walk inside, a walking surface consisting of hundreds of miniature balls, an air-walker, a treadmill that rotates, and walking slippers. However, the current systems all have at least one or more shortcomings that include: restrictive motion, being limited to upright motion, noisy, complicated, requires a tracking system, and, during acceleration transitions, having a tendency of causing the user to slip or fall.

Preferably, an ODT needs a surface that reacts to movement in any direction so that the user remains in a small set area. As discussed above, some ODTs incorporate rollers in the sideways or transverse direction to allow the user to slip back to the center of the ODT. However, the disadvantage with this design is that the slippery motion does not allow the user to walk freely. The ODT with rollers also tends to leave the user with the feeling of stepping and then sliding, not a natural walking motion.

Accordingly, there is a need for an ODT that is simple to operate, that provides smooth accelerations and transitions, that is relatively quiet, and that can control the damping or stiffness in any planar direction. Furthermore, there is a need for a method of making the ODT with all the advantages discussed.

SUMMARY

According to the present invention, there is provided an Omni-directional treadmill comprising a frame, a traversable platform mounted on the frame, two powered offset casters each comprising a wheel, a roll motor, a steer motor, and a gear train, and a control system for controlling the two powered offset casters, and wherein the wheels of the powered offset casters are in contact with the traversable platform.

According to another aspect of the present invention, there is provided an Omni-directional treadmill comprising a traversable platform mounted on a base, the traversable platform comprising a platform frame and a belt stretched in-part over the platform frame, two powered offset casters each comprising a wheel and a roll motor for imparting rotational motion to the wheel, and a control system; wherein the wheels of each powered offset casters are in contact with the belt; and wherein the two powered offset casters comprise a translational motion that is controllable by the control system.

According to still another aspect of the present invention, there is provided an Omni-directional treadmill comprising a control system, a base and a traversable platform mounted on the base; the traversable platform comprising an internal frame and a belt stretched over the frame; the traversable platform being in direct contact with two wheels of two offset casters, and wherein the two offset casters each comprising a braking mechanism for controlling the rotational motion of the wheel.

In still yet another aspect of the present invention, there is provided a method for imparting planar motion and a rotational motion to a walking surface to form an Omni-directional treadmill comprising the steps of forming a traversable platform by assembling an internal platform frame and covering the internal platform frame with a stretchable fabric material, the platform frame comprising either spherical rollers or Omni-directional rollers and the stretchable fabric material comprising an external walking surface. Forming a base, the base having at least one of a plurality of spherical rollers or offset casters mounted in a first plane and a second plane and placing the traversable platform over the base such that the traversable platform is in contact with the plurality of spherical rollers or offset casters along the first and second planes. Engaging the external walking surface of the stretchable fabric material with an offset caster assembly, the offset caster assembly comprising a wheel, a caster frame, a motor and a gear train, the wheel comprising a wheel speed and a wheel angle position; and controlling the offset caster assembly with a system controller that is adapted for controlling the wheel speed's rotational or position velocity.

Other alternatives and embodiments for implementing an ODT in accordance with the practice of the present are also described herein and further discussed below in the Detailed Description section.

BRIEF DESCRIPTION OF THE DRAWINGS

These and other features and advantages of the present invention will become appreciated as the same becomes better understood with reference to the specification, claims and appended drawings wherein:

DETAILED DESCRIPTION

The detailed description set forth below in connection with the appended drawings is intended as a description of the presently preferred embodiments of the ODT provided in accordance with the present invention and is not intended to represent the only forms in which the present invention may be constructed or utilized. The description sets forth the features and the steps for constructing and using the ODT of the present invention in connection with the illustrated embodiments. It is to be understood, however, that the same or equivalent functions and structures may be accomplished by different embodiments that are also intended to be encompassed within the spirit and scope of the invention. Also, as denoted elsewhere herein, like element numbers are intended to indicate like or similar elements or features.

Figure 1:
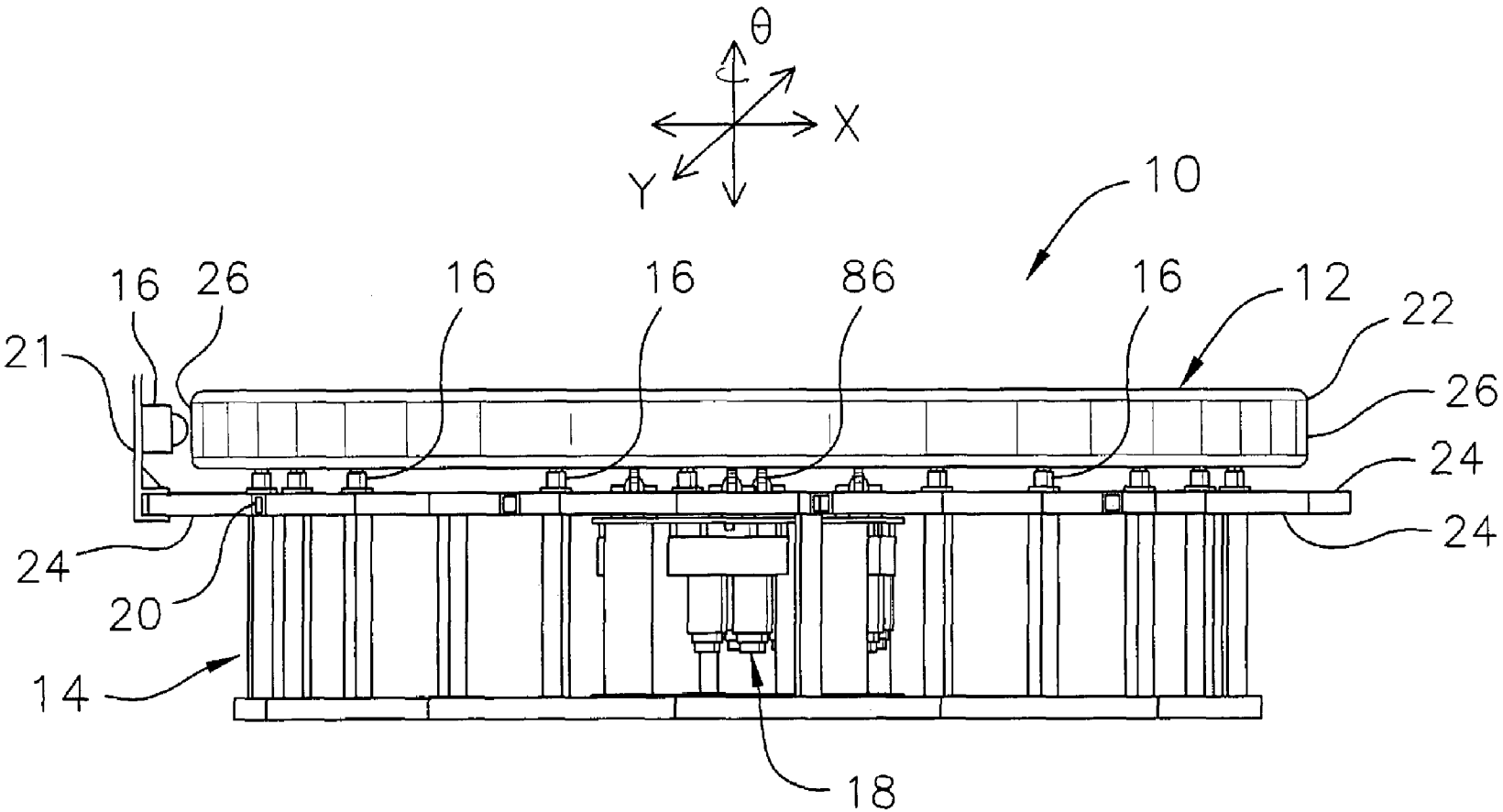
FIG. 1 is a semi-schematic side view of an ODT provided in accordance to one practice of the present invention.

Referring now to FIG. 1, there is shown an ODT provided in accordance to one embodiment of the present invention, which is generally designated 10. The ODT 10 generally comprises a traversable platform 12 positioned over a cage or frame 14. The traversable platform 12 is capable of traveling in the X, Y, and theta directions relative to the frame 14 based in part on a plurality of spherical rollers 16 and powered offset casters 18 mounted below the platform 12. As further discussed below, the plurality of rollers 16 are mounted around the perimeter 20 of the frame 16 to support the perimeter 22 of the platform 12 and the plurality of powered offset casters 18 are adapted to transmit motion to the belt or shell of the platform to adjust the compliance between the user and the ODT. In other words, the powered offset casters 18 are adapted to regulate the surface that the user walks on so that the user feels a consistent walking sensation when walking in any planar direction.

Although shown only as a partial exemplary view for clarity purposes, the ODT 10 further comprises restraining walls 21 around the perimeter of the frame 20 for maintaining the platform 12 centered relative to the base. The restraining walls 21 are coupled to the extension arms 24 and extend vertically therefrom, i.e. extend parallel to the edge 26 of the platform 12. The extension arms 24 extend radially outwardly from the upper perimeter 20 of the frame 14. A plurality of spherical rollers 16 are mounted between the restraining walls 21 and the edge 26 of the platform to both maintain the platform in the center position relative to the base and to provide a rolling surface for the belt or shell, as the same is rotated over an internal platform frame.

Figure 2:
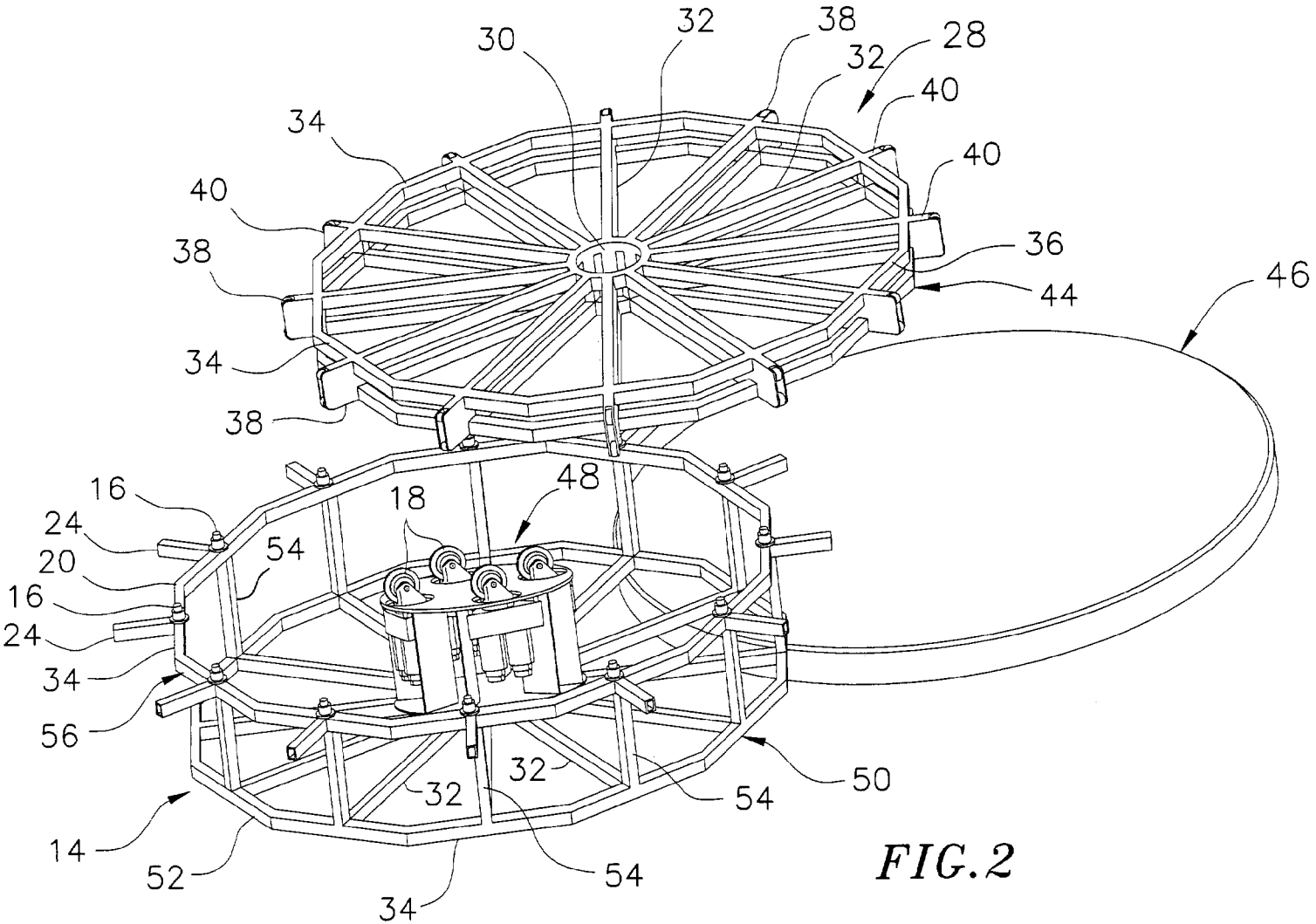
FIG. 2 a semi-schematic perspective view of the base and traversable belt of the ODT of FIG. 1 in an unassembled state.

FIG. 2 is a semi-schematic perspective view of the ODT 10 in an unassembled state. Specifically, there is shown an internal platform frame 28 constructed from a plurality of square or rectangular tubing and metal plates. In the center of the platform frame 28 is a central steel hub 30. Extending from the hub 30 are a plurality of spokes 32, which include one or more perimeter arc braces 34 to hold two adjacent spokes together. Along the perimeter 36 of the platform frame 28 are support plates 38, which are each adapted to receive an Omni-directional wheel 40 (also shown in FIG. 4). Together, the spokes 32, and the perimeter arc braces 34 form a first platform frame layer 42. To provide added strength to the platform frame 28, a second platform frame layer 44 may be added just below the first platform frame layer and is fixed to the first frame layer via the hub 30 and the support plates 38.

The internal platform frame 28 is constructed by assembling steel tubing, plates, brackets, etc. via conventional means, such as by welding, fastening, and riveting the components together. The tubing size and strength should be commensurate with the expected load that the ODT will handle plus some acceptable engineering safety factor. The platform frame 28 may be shipped in small pieces and assembled on-site by using brackets and fasteners to join the connecting members together instead of welding the connecting members together.

To provide a slick surface for the belt or shell to transverse over as the same rotates during use, the platform frame 28 is fitted with two sheets (not shown) along the upper and lower surfaces with each sheet having a low friction slippery surface characteristic, such as ultra high molecular weight polyethylene tape. The slippery sheet is placed on the frame 28, over the hub 30 section of the first frame layer 42 and the second frame layer 44 and preferably on or inside the perimeter 36 of the frame 28. Optionally, the slippery sheets are anchored to or attached to the frame 28 so that the slippery sheets do not move relative to the frame when a force is applied to the sheets via the belt or shell. For example, a ultra high molecular weight polyethylene tape with a self-adhesive backing can be used. This tape provides a nonstick, low-friction surface, similar to Teflon tape, but with higher abrasion and puncture resistance.

The belt 46, which together with the platform frame 28 and the Omni-directional wheels 40 produce the traversable platform 12, is shown adjacent the platform frame (FIG. 2). The belt 46 comprises a shape that is complimentary to the shape of the platform frame 28. In one embodiment, the belt 46 has a spherical or dome shape and has an opening sized to fit around the platform frame 28. The belt 46 may be made from a number of stretchable fabric with smooth interior surface for contacting with the low friction sheets, including Thermal Stretch™ by Malden Mills, neoprene, ApeX™ Neoprene, SCS™ Neoprene by Hydroskin, etc. Standard 2-ply treadmill belts can also be used which have a rubber surface to walk on and a nylon fabric incorporated underneath. The nylon surface acts as an abrasion resistant slippery surface. The stretchable fabric should be capable of stretching in at least two dimensions and recovers its original shape upon removal of the stretching force. The opening may be closed subsequent to sliding the belt over the platform frame by any number of methods, including by Velcro straps, stitching, adhesive, zippers, and lacing the opening closed. The belt 46 is preferably stretched tight over the platform frame 28 so that when the powered offset casters 18 act upon the belt, the belt moves in reaction thereto with little or no slippage.

Once the traversable platform 12 is assembled, the belt 46 moves about the platform frame 28 by sliding relative to the slippery sheets and rolling over the Omni-directional wheels 40 mounted along the perimeter of the frame. During the belt rotation, the belt 46 moves from a greater stretched state, as it moves over the widest dimension of the frame, to a lesser stretched state by recovering or returning to a slightly stretched state as it moves over a smaller dimension of the frame. Although Omni-directional wheels 40 are discussed, spherical rollers 16 may be used instead of or in addition to the Omni-directional wheels.

The base 14 is shown with a manipulator 48 positioned inside. The manipulator 48 houses a plurality of powered offset casters 18 and is responsible for maintaining the compliance on the belt 46 as further discussed below. The base 14, which has similar construction as the platform frame 28, comprises a central hub (not shown), a plurality of spokes 32 extending from the central hub, and a plurality of arc braces 34 with each arc brace connecting two adjacent spokes together. The hub, spokes 32, and arc braces 34 form the lower base frame 50 of the base 14. At selected locations along the various arc braces 34, which form the perimeter 52 of the lower base frame 50, a plurality of legs 54 extend generally vertically and generally perpendicularly to the plane defined by the lower base frame 50.

Additional arc braces 34 are utilized to connect two adjacent legs 54 together to form an upper base ring 56. The upper base ring 56 is then fitted with spherical rollers 16 and extension arms 24, as previously discussed. The spherical rollers 16 may be placed on the arc braces 34 of the upper base ring 56 directly over the vertical legs 54 to ensure proper weight bearing for the base 14 when the traversable platform 12 is placed over the same during final assembly.

The manipulator 48 is shown centrally located relative to the lower base frame 50. In one exemplary embodiment, the manipulator 48 is mechanically anchored to the lower base frame 50 to provide sturdiness during operation and to guard against movement of the manipulator relative to the frame. In another embodiment, the manipulator 48 comprises four separate manipulators each separately and mechanically anchored to the lower base frame 50 and each having a powered offset caster 18 coupled therein. In the latter embodiment, the four manipulators are evenly distributed and mounted to the base frame. However, even distribution is not a requisite for the ODT 10. But even distribution would be much easier to control, set up, and program due to the symmetry. A plurality of powered offset casters is needed to control the motion of the traversable platform. If one powered offset caster is used, the one caster is needed for translational motion. When two casters are used, the two casters can be used to control translational and rotational motion of the belt. If more than two casters are used, the more than two casters can be used to impart more force on the belt 46 and reduce any wrinkling on the belt as compared to just two powered offset casters. In addition, powered offset casters 18 may be used in combination with non-motorized offset casters. For example, two powered casters and at least one but preferably two non-motorized casters can be used underneath the platform to support the same.

Although the construction of the base 14 and the platform frame 28 are described with specificity, the base and the frame may be constructed from alternative materials and design including changes such as using carbon fiber, varying the shape of the base, using cross-braces to strengthen the base, and using offset casters instead of spherical rollers, etc. Accordingly, such changes are contemplated to fall within the scope of the present invention.

Figure 3:
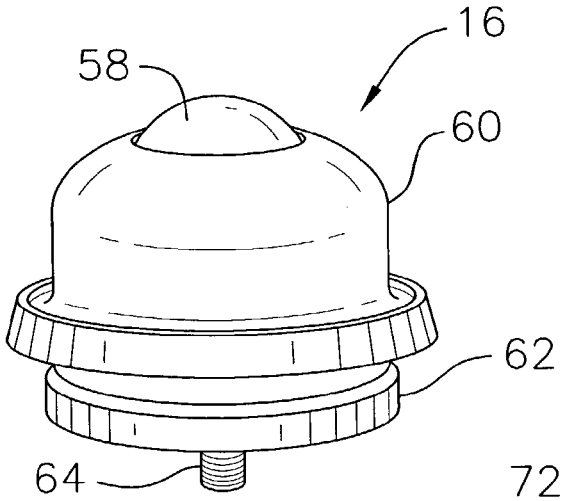
FIG. 3 is a semi-schematic side view of a spherical roller useable with the ODT of FIG. 1.

FIG. 3 depicts a spherical roller 16 that may be usable with the ODT of the present invention. The spherical roller 16 comprises a roller ball 58 trapped inside a housing 60 and having a base 62 that comprises a stem 64. The spherical roller may be attached to the base 14 and elsewhere on the ODT 10 by threading the stem directly into either the arc braces 34, the restraining walls 21, or the tubing portions that form the base. Alternatively, a nut sized to match the profile of the stem may be welded to the base and the stem 64 threaded directly into the nut. Other conventional attachment means are also contemplated within the present invention and are considered to fall within the scope of the present invention. The spherical roller 16 is commercially available from a number of manufacturers, including and can be purchased at a distributor such as McMaster-Carr.

Figure 4:
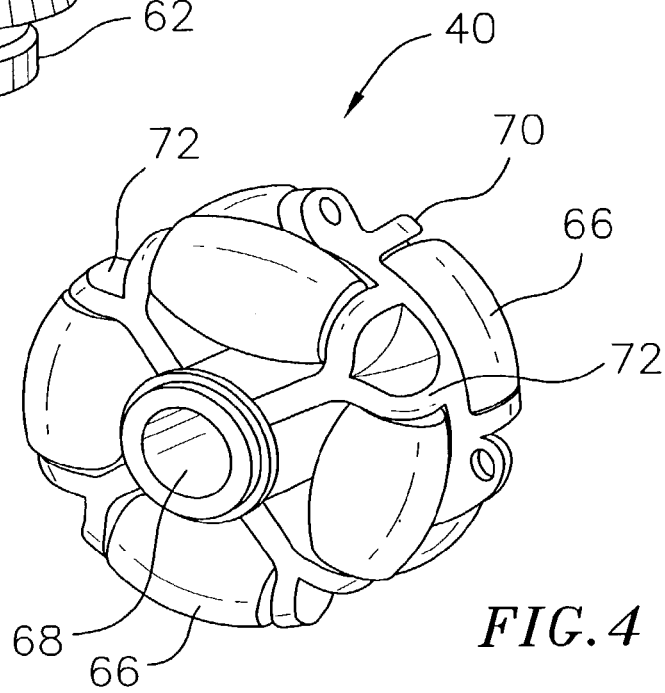
FIG. 4 is a semi-schematic perspective view of an Omni-directional wheel useable with the ODT of FIG. 1.

FIG. 4 is a perspective view of an Omni-direction wheel 40 usable with the platform frame 28 of the present invention. The Omni-directional wheel 40 is commercially available from McMaster-Carr under the category "Skate Wheels" and comprises a plurality of generally cylindrical rollers 66. Assuming that the connection hub 68 of the wheel 40, which allows the Omni-directional wheel 40 to attach to a support bracket, defines a first axis of rotation for the wheel, the plurality of generally cylindrical rollers 66 are individually mounted on a number of different axes of rotation, with each axis capable of providing a rolling support for the belt. The plurality of generally cylindrical rollers 66 are mounted to a cage 70, which comprises a number of webs 72 for retaining the ends of the individual generally cylindrical roller 66.

Figure 5:
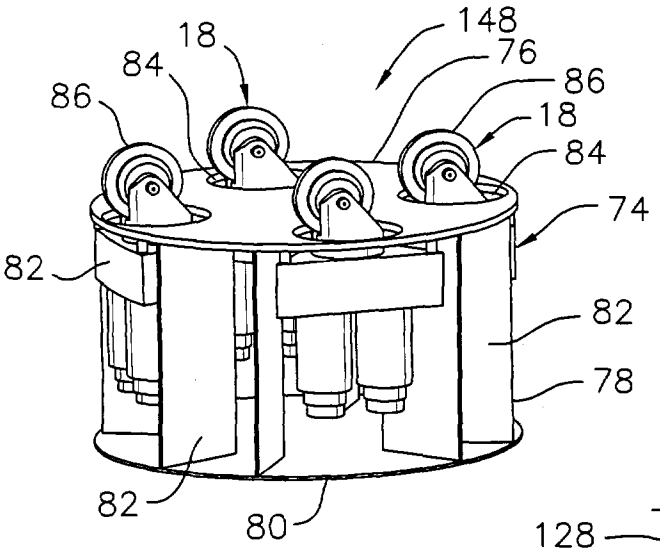
FIG. 5 is a semi-schematic perspective view of a manipulator with a plurality of powered offset casters mounted therein for moving the belt of the ODT of FIG. 1 provided in accordance with the practice of the present invention.

FIG. 5 shows an exemplary manipulator 48 provided in accordance to one practice of the present invention. Broadly speaking, the manipulator comprises a housing 74, which has an access hatch 76, a housing frame 78, and a housing base 80. The housing frame 78 may comprise of individual plates and brackets 82 welded to the base 80 and sized to accommodate a plurality of powered offset casters 18, such as providing holes and brackets for receiving the frame of the powered offset casters.

The access hatch 76 may include access openings 84 for the wheels 86 of the powered offset casters 18 to protrude therethrough when mounted in the central cavity of the housing. The number of access openings 84 will depend on the number of powered offset casters 18 used for the manipulator 48, which in the present embodiment includes four, but two, three, five or more powered offset casters may also be used. One caster may be used as well, but if only one powered offset caster is used, then the motion of the belt is limited to the X and Y directions only. The access hatch 76 can mate to the housing 74 by any number of methods, including securing to the housing via fasteners, clamps, and welding. If welding is selected, provisions should be made so that the powered offset casters 18 can be mounted to or be removed from the housing by accessing through the base 80 or the housing frame 78. Although the housing 74 is shown as having a generally cylindrical configuration, other alternative shapes or configurations and other attachment methods are also acceptable.

As previously discussed, instead of having a single manipulator 48 that comprises a housing 74 and a plurality of powered offset casters 18, the manipulator 48 may comprise separate housings 74 with each housing adapted to receive a powered offset caster. If multiple housings are utilized, the multiple housings are preferably mounted in a spaced apart relationship within the base 14 of the ODT 10 or above the traversable platform 12 as further discussed below.

Figure 6:
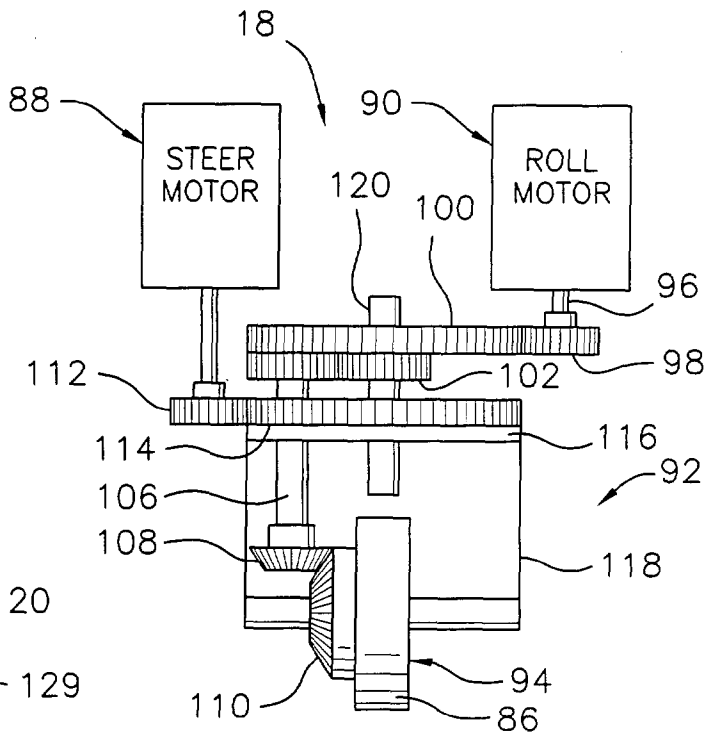
FIG. 6 is a semi-schematic cross-sectional front view of the powered offset caster of FIG. 5.
Figure 8:
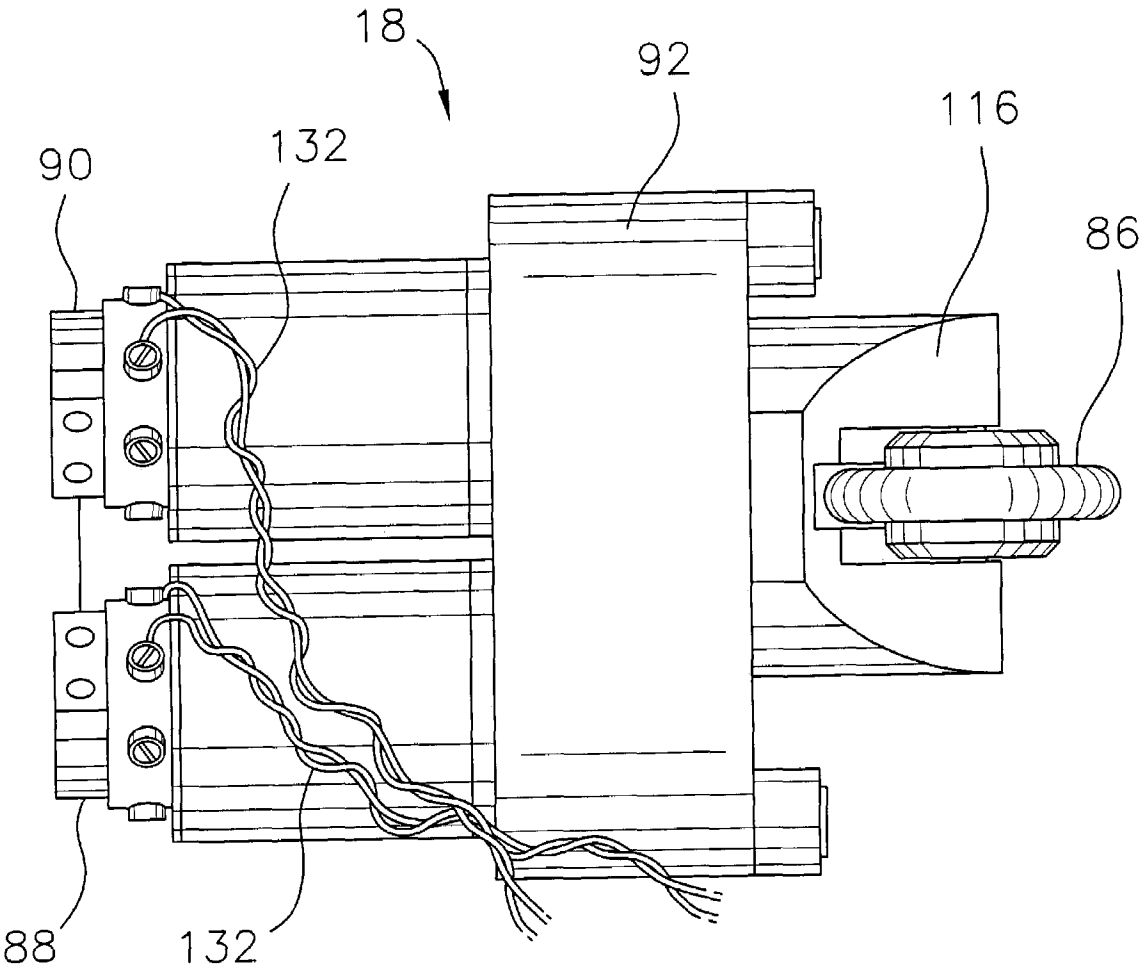
FIG. 8 is a front view of the powered offset caster of FIGS. 5 and 6.

FIG. 6 is a semi-schematic partial cross-sectional view of a powered offset caster 18 usable with the present ODT 10. As shown, the powered offset caster 18 comprises a steer motor 88, a drive motor 90, a gear train 92, and an offset caster 94. The powered offset caster 18 can be acquired through Nomadic Technologies, Inc., which is owned by 3Com. A side view of a Nomadic Tech. powered offset caster 18 is shown in FIG. 8.

Broadly speaking, the powered offset caster 18 is capable of providing translation motion to the wheel 86 and angular motion to the caster 94 via the steer motor 88 and the roll motor 90 receiving motorized signals from a control unit (further discussed below) to rotate the gear train 92.

The roll motor 90 is a DC motor capable of bi-directional rotation depending on the feed signal of the control system to the motor. Brushless DC motors, AC motors, and stepper motors can be used as well. The roll motor shaft 96 has a roll output gear 98 mounted to an end thereof. The roll output gear 98 rotates the first bull gear 100, which rotates the stepped-up gear 102 directly coupled thereto. The roll output gear 98 and the first bull gear 100 are a set of helical gears but may be a worm and a wormgear, respectively.

The stepped-up gear 102 is meshed with a companion gear 104, which drives the roll output shaft 106 and the pinion gear 108 coupled to the end thereof. The pinion gear 108 is adapted to turn the wheel 86, which has a rotational axis mounted at a 90° angle to the pinion gear 108 rotational axis, via the bevel gear 110. The bevel gear 110 is directly coupled to the wheel 86 and rotates the wheel 86 in a one-to-one relationship. Accordingly, via known gearing technology and gearing calculations, by knowing the individual characteristics of each gear, such as gear ratios, diameters, gear teeth, wheel diameter, etc., the wheel rotation or speed may be calculated for a given motor rotational speed.

The angular rotation of the caster 94 may be manipulated in the same manner as described above for the rotation of the wheel 86. In particular, a steer motor 88 is used to turn a steer output gear 112. The steer output gear 112 is meshed with a second bull gear 114, which is directly connected to a steering frame 116. The steering frame 116 is in turn connected to the caster frame 118, which is adapted to turn via the turning shaft 120. Accordingly, by knowing the gear characteristics of the steer output gear 112 and the second bull gear 114, which is a set of helical gears but may comprise a worm and wormgear respectively, the rotation of the caster 94 may be calculated.

As may be recognized by a person of ordinary skill in the art, when the caster 94 rotates, either in a clockwise/first direction or counter-clockwise/second direction, the steering frame 116 rotates the roll output shaft 106 along with the rotation. This is because the roll output shaft 106 projects through the steering frame 116 and terminates with the pinion gear 108. Hence, with the projection through the steering frame 116, the following scenarios can occur (assuming that a clockwise steer motor shaft output produces a counter-clockwise caster output and a counter-clockwise roll motor output produces a forward wheel output): (1) if the roll motor turns counter-clockwise and the steer motor also turns clockwise, then the roll motor will have a slight counter-clockwise input in speed, which translates into a slight increase in forward wheel speed; (2) if the roll motor turns counter-clockwise and the steering motor turns counter-clockwise, then the roll motor will have a slight counter-clockwise reduction in speed, which translates into a slight reduction in forward wheel speed; (3) if the roll motor turns clockwise and the steer motor also turns clockwise, then the roll motor will have a slight clockwise reduction in speed, which translates into a slight decrease in backward speed; and (4) if the roll motor turns clockwise and the steer motor turns counter-clockwise, then the roll motor will have a slight clockwise input in speed, which translates into a slight increase in backward speed. Therefore, to adjust for the slight increase or reduction in the forward or backward rotation of the wheel when the steer motor turns (i.e., to provide a consistent feel to the user of the ODT 10), the roll motor 90 should be compensated depending on the clockwise or counter-clockwise rotation of the steer motor 88 and whether the roll motor 90 is operating in the same or different rotation as the steer motor. The following equations give the kinematic relationship between the roll motor 90 and the wheel 86, and the steer motor 88 and the angular motion to the caster 94. The gear ratios are calculated based on the number of teeth on each respective gear.

$$\Theta_{steer\ motor}=-(93/28)*\theta_{caster}$$

$$\Theta_{roll\ motor}=-(85/36)*\theta_{caster}+(85/36)*(32/16)*\theta_{wheel}$$

$\Theta_{roll\ motor}$ angular position of the roll motor 90

$\theta_{wheel}$ angular position of the wheel 86

$\theta_{steer\ motor}$ angular position of the steer motor 88

$\theta_{caster}$ angular position of the caster 94

Figure 7:
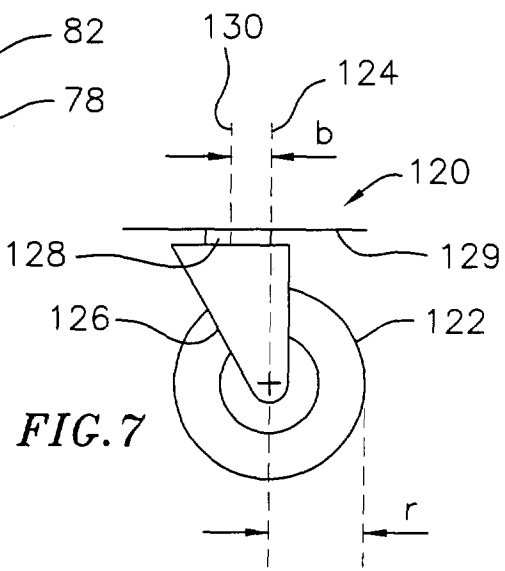
FIG. 7 is a semi-schematic cross-sectional side view of an offset caster.

FIG. 7 is a semi-schematic exemplary cross-sectional side view of a conventional offset caster 120, which is shown to establish some terminology. As shown, the caster comprises a wheel 122, which is pivoted about a first axis 124. The caster 120 further includes a frame 126, which comprises a swivel mechanism 128, such as a bearing, and an attachment bracket 129. The swivel mechanism 128 includes a swivel axis, which corresponds to a second axis 130. When the first axis 124 and the second axis 130 are spaced apart, the caster 120 is said to be an offset caster. This offset is commonly referred to in the industry as a swivel lead, and will be labeled herein throughout as offset "b". The wheel radius of the wheel 122 is simply the length measured from the center of the wheel and the perimeter of the wheel, which will be labeled herein throughout as wheel radius "r".

FIG. 8 is a semi-schematic side view of a powered offset caster 18 as offered by Nomadic Technologies Inc. The figure shows the steer motor 88, the roll motor 90, the gear train 92, the steering frame 116, and the wheel 86. In addition, electrical leads 132 are shown with quick-connect terminals 134. Although the specific powered offset caster 18 is shown and described above, other powered offset casters and gearing arrangements are contemplated, including the powered offset casters provided by Nova-Tech Engineering, Inc., out of Mountlake Terrace, Wash., and using gear differentials to compensate for the turning of the caster and rotation of the wheel instead of the same gear train described above and shown in FIG. 6.

Figure 9:
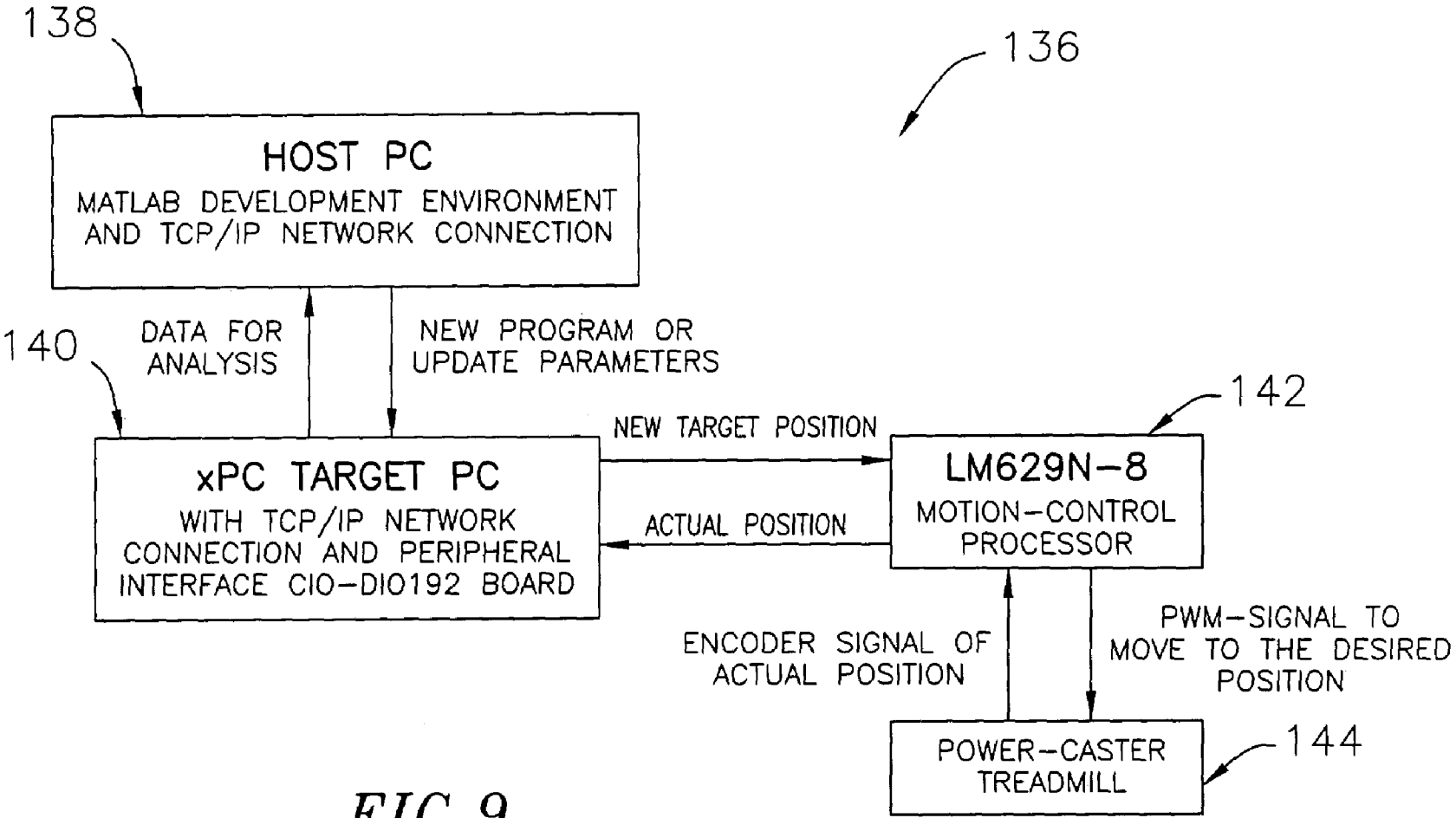
FIG. 9 is a system control block diagram for controlling the ODT of FIG. 1 provided in accordance to one practice of the present invention.

Referring now to FIG. 9, there is shown a flow diagram of the control system 136 for controlling the movement of the belt 46 of the ODT 10 provided in accordance with practice of the present invention. The control system 136 can be thought of as performing a series of tasks, including the following three tasks: In the first task, the desired motion of the user may be determined and when determined, used as the input for the control system 136. The desired caster orientation and wheel position will be calculated based on the desired motion and will be the output of the first task. The calculation takes into account the position of the steer motor 88, roll motor 90, and the gearbox 92. This calculation converts the desired motion into desired caster and wheel position.

The position of the caster is measured from a home position in radians sensed at initial start-up. At the start-up of the system, each caster rotates until a photoelectric sensor senses a tab, which may be located on the steering frame 116 or elsewhere as desired. When the photoelectric sensor is activated, the caster is stopped and the home position is determined. The gear ratios in the gearbox are used to convert motor degrees into shaft degrees for necessary calculations.

In the second task, a motor controller or processor 142 must input the desired steer motor and roll motor positions and ensure that the actual position equals the desired position (the desired steer motor and roll motor positions are calculated from the first task). The steer motor 88 orients the caster and the roll motor 90 rotates the conventional wheel. All casters should move in unison and the motor controller oversees the movement to ensure uniformity.

In the third task, damping and stiffness control of the belt 46 are determined and adjusted. A control system may be used to adjust the desired damping and stiffness coefficients of the caster 94 and wheel 86 to thereby adjust the surface of the belt 46, which is in contact with the wheels 86 of the powered offset casters 18. Thus, the damping and stiffness of the surface of the belt 46 can be adjusted by adjusting the output of the wheels 86 and casters 94. Therefore, the feeling of the surface could be adjusted and tailored for different environments, such as feeling icy or undulating. To control the desired damping and stiffness of the system, a damping and stiffness equation is used which takes into account the motor torque and the gear transmission ratio.

In one exemplary embodiment, a rapid embedded programming method was used to develop the computer control system, hardware, and code. The primary components of the system include MATLAB's Real Time Workshop™ in a Host PC environment 138 and a xPC Target™ Toolbox 140. Control equations for the first and third tasks are created using the Matlab interface. A motion control processor 142 (LM629N-8 from National Semiconductor Corporation) and a digital I/O board (CIO-DIO192, available from Talisman Electronics, Omega.com and other retailers) are used to insure that the actual and desired motor positions are matched (i.e., the second task). The flow diagram of the system is shown in FIG. 9.

As discussed above, the Matlab Host environment is used to develop the control algorithms for the first and third tasks. However, for control algorithms that are known, the host environment may not be needed and the control algorithms can reside within the target PC 140 or a dedicated microprocessor or microcontroller. During initial control computations and development, different algorithms are downloaded to the target PC 140 from the host PC 138 via network connection to run different control algorithms used in the first and third tasks. In one embodiment, the network connection used is a TCP/IP network connection, but other connections can be used such as USB, firewire, and bluetooth. Parameters such as stiffness coefficients and controller gains for the second and third tasks can be downloaded to the target PC 140. Data, such as the desired and actual positions of the motor, can be uploaded from motion control processor 142 to the target PC 140 to be analyzed and the control gains can be adjusted during the control computations. Via the network connection, the target PC 140 may be communicated with from anywhere via the Internet.

The target PC 140 runs the control code using the xPC real-time operating system. The target PC 140 is dedicated to run the control code and can operate in real-time to complete tasks at a given sampling rate. The target PC 140 also runs the control algorithms for the first and third tasks and can download the desired motor positions to the dedicated motion control processors in the respective motor. The target PC 140 also receives information uploaded by the motion-control processor 142 regarding the actual motor positions. Alternatively, instead of the Matlab environment, other operating systems such as QNX, VxWorks, LabView Real-time, and other real time operating systems can be used and programmable logic controllers can be substituted for the Target PC. These commercial operating systems allow for input signals and control calculations in similar fashions as that described and shown in FIG. 9.

The actual position of the motor shaft is measured using an encoder. The encoder accuracy is 2048 slots per 360 degrees, and the accuracy is increased by a factor of 4 with dual channels sensing the encoder slots. The motor position is converted to caster and wheel positions by multiplying by the appropriate gear ratios. For example, if the motor rotates at 8000 counts and there is a gear ratio of 10, then the caster will rotate (8000 motor counts) times (1 motor revolution/(2048 times 4 counts)) times (1 caster revolution/10 motor revolutions) times (360 degrees/revolution)=35.2 degrees.

The LM629 chip 142 mounted on each motor controls the motion of the respective motor by controlling its position or velocity. In position control, an error is calculated between the desired and actual position and a control signal is calculated based proportionally on the error (P), based on the derivative of the error (D), and based on the integration of the error (I). A standard PID calculation is done. The control signal has two parts. The first part is the direction of motion based on moving the motor clockwise or counter-clockwise to reduce the error. The second part of the signal is a duty cycle in the form of a standard pulse width modulated signal (PWM). When the pulse is high, the motor is on full power and when the pulse is low then the motor is turned off. This analogy is like pedaling a bike very fast and then coasting. Other off-the-shelf motor control processors are suitable as well including motion control from Eason Technology and the PILOT from PMD Corporation.

In the present embodiment, the control algorithm on the Target PC communicates with eight motion control processors. These processors ensure that the actual position equals the desired position using a standard PID (proportional, integral, and derivative) control law stated earlier. The LM629 chip sends out a pulse width modulated signal (PWM) to the amplifier, which powers the motor. The amplifier is located next to each motor and converts the low voltage (5V) and low amperage signal (mAmp) into a high voltage (24V) and high amperage signal (0-5 amps). An encoder, which is a standard angular position sensor mounted on top of the motor, measures the actual position of the steer motor 88 and/or roller motor 90 and sends that data back to the LM629 chip to complete the feedback loop.

The desired translational and rotational motion of the treadmill belt must be determined. The translational motion is the speed of the belt in either the X and/or the Y direction (i.e., forward and lateral directions). The rotational motion or theta is the ability of the belt surface to rotate about the vertical axis. In this manner, the user can walk naturally in the plane or can walk in circles. The user can input their desired translational motion and rotational motion using a simple joystick or buttons similar to motorized one-dimensional treadmills. The user's desired motion can also be sensed by: a harness that measures the position of the user on the treadmill; string potentiometers to measure the position of the user; ultrasonic or laser sensors to measure the position of the user; multiple camera systems which measure the 3D position of the user; LED systems which triangulate the position of the user; GPS sensor to determine the velocity and position of the user; multiple photoelectric sensors to determine the position of the user; keypad input; and voice commands.

In another exemplary control system (not shown), the manipulator 48 is set for passive control. In the passive control system, the user's desired input is not measured and the calculations to determine each wheel position and caster position are not performed. Instead, as the user takes a step in a particular direction, the free-spinning casters will align automatically to the motion of the user, much like an office chair. However, the wheel motion will be braked or adjusted so that the belt surface does not feel icy. The amount of braking torque on each wheel can be determined as discussed above for the third task. A motor control processor discussed in the second task for the wheel 86 is needed to control its motion. In short, the first task is not necessary for the passive system. Thus, in a passive system, the powered offset caster does not require a steer motor and only one motor is required to control the translation motion of the wheel, i.e., to brake or speed up the wheel.

A standard Jacobian, "J", is used to calculate the wheel and caster angular velocities given the desired user motion. The Cartesian velocity is the input velocity determined by sensing the user's desired motion (in a passive system, these calculations do not need to be performed). The Cartesian velocity is the input velocity that corresponds to the user's motion (such as entering a 5.0 speed on a regular one-dimensional treadmill, but in an Omni-directional treadmill the speed in two directions and the rotation must be sensed). In contrast, in a passive system discussed above, the Cartesian velocity is simply the velocity that the user walks or runs at. The desired input Cartesian velocity is determined using a sensor from among the many options discussed above.

The wheel radius, r, and the offset, b, are determined from the caster design. The inverse of the Jacobian always exists because of the offset value, b, which is greater than a zero. Omni-directional motion is achieved because this Jacobian always exists. The position of the caster must be known to determine the values for the matrix discussed below. It is determined by measuring the caster 94 angular position from a home position determined at the start-up of the system. At the start-up of the system, each caster rotates until a photoelectric sensor senses a tab on the caster frame 116. When the photoelectric sensor is activated, the caster is stopped and the home position is determined.

$$J = \begin{pmatrix} -r\cos(\Theta_{caster}) & -b\sin(\Theta_{caster}) \\ -r\sin(\Theta_{caster}) & b\cos(\Theta_{caster}) \end{pmatrix}$$

-continued $$\begin{pmatrix} \dot{\Theta}_{wheel} \\ \dot{\Theta}_{caster} \end{pmatrix} = \begin{pmatrix} -\frac{1}{r}\cos(\Theta_{caster}) & -\frac{1}{r}\sin(\Theta_{caster}) \\ -\frac{1}{b}\sin(\Theta_{caster}) & \frac{1}{b}\cos(\Theta_{caster}) \end{pmatrix} \begin{pmatrix} \dot{X} \\ \dot{Y} \end{pmatrix}$$

$$\begin{pmatrix} \dot{\Theta}_{wheel} \\ \dot{\Theta}_{caster} \end{pmatrix} = J^{-1} \begin{pmatrix} \dot{X} \\ \dot{Y} \end{pmatrix}$$

The desired motor positions are then obtained by integration and the motor positions 88 and 90 are then sent to the LM629 chip via the digital input/output board. The servo control loop is performed in the motion control processor.

$$\theta_{wheel} = \frac{1}{2\pi r}\int\left[-\dot{X}\cos(2\pi\theta_{caster}) - \dot{Y}\sin(2\pi\theta_{caster})\right]dt$$

$$\theta_{caster} = \frac{1}{2\pi b}\int\left[-\dot{X}\sin(2\pi\theta_{caster}) + \dot{Y}\cos(2\pi\theta_{caster})\right]dt$$

$\theta_{wheel}$ is the angular position of wheel 86; $\theta_{caster}$ is the angular position of the caster 94. X and Y are the desired Cartesian velocities, and r is the radius of the wheel and b represents the caster offset.

The motors of the manipulator are controlled using the LM629N-8 motion-control processors from National Semiconductor, which may be located in a control box next to the motors. These desired positions, $\theta_{wheel}$ and $\theta_{caster}$, are converted to $\theta_{roll\ motor}$ and $\theta_{steer\ motor}$. $\theta_{roll\ motor}$ and $\theta_{steer\ motor}$ are compared to the actual positions of the steer motor and roll motor and the error is used to adjust the command signal to the motor. A standard PID motor control calculation is used for this task.

Figure 10:
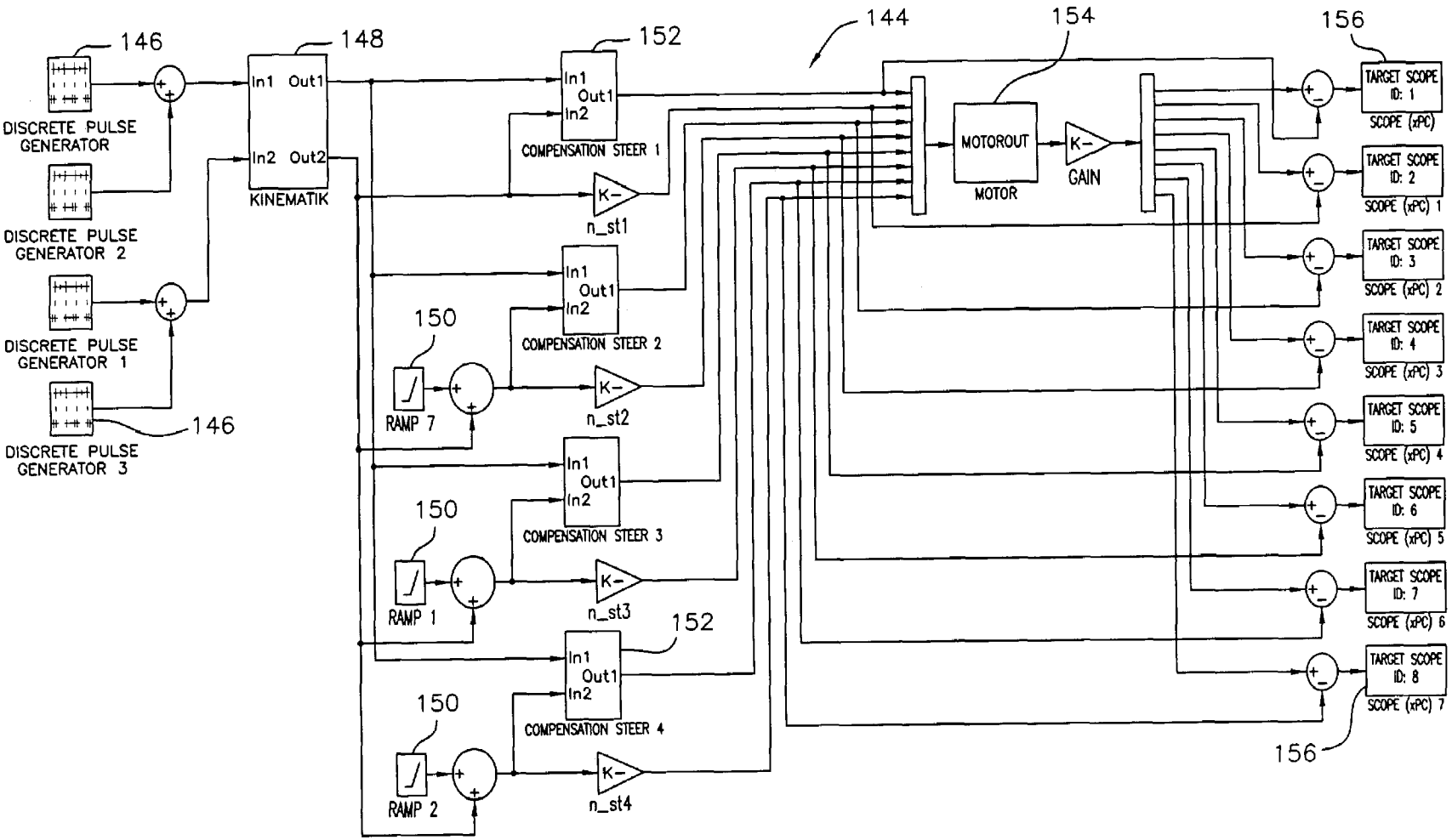
FIG. 10 is a Simulink model of the control system of FIG. 9.

FIG. 10 shows a graphical control model such as a Simulink control model 144 designed in the host computer 138 for controlling the ODT 10. Other graphical control model that may be used with the control system includes MathWorks, Real-Time Workshop, and other similar graphical real-time operating systems. Once the final algorithms are determined and the host computer is not required, the control model may reside in the target PC 140 and will continuously run on the target PC. The desired Cartesian velocities are the input signals for the motion of the traversable platform 12. The input signals are then converted to desired caster and wheel positions using the Jacobian. Finally, the caster and wheel positions are converted to the desired roll and steer motor positions using the gear ratios as described above. In the Simulink model 144, the desired signals are represented by fixed blocks, such as the Discrete Pulse Generators 146. The "Kinematic" block 148 converts the desired Cartesian velocities to the desired caster and wheel positions based on the Jacobian.

The ramp blocks 150 adjust the caster positions of the $2^{nd}$, $3^{rd}$, and $4^{th}$ caster after start-up and then match them with the first caster so that all four casters are aligned. The number of casters will determine the number of ramp blocks 150 necessary. When the casters are in the home position, they may all be pointed outward around a circle. To align all of the casters, the first caster may be left alone, but the $2^{nd}$ caster may be rotated 90 degrees clockwise; the $3^{rd}$ caster may be rotated 180 degrees clockwise; and the $4^{th}$ caster may be rotated 90 degrees counter-clockwise. During start-up the home position is determined for each caster, and then the $2^{nd}$, $3^{rd}$, and $4^{th}$ casters are rotated so that all are aligned. The same sequence may be applicable where there are fewer or more than four powered offset casters.

The compensation blocks 152 cancel the coupling between the steer motor 88 and the roll motor 90. That is, the compensation blocks compensate for the rotation of the wheel when the steer motor 88 rotates the angle of the caster. As discussed above, there is coupling between the orientation and the rotation of the powered caster wheel. If the orientation of the caster is changed, then the wheel also rotates because of the mechanical structure of the powered caster (i.e., the rotation either increases or decreases the forward or backward speed of the wheel). To uncouple the system, the gear transmission ratio of the caster has to be considered. The position or speed of the wheel motor must be the sum of two terms, which include both the desired caster position and the desired wheel position. In the equations shown below to perform the stated function, the ratios 93/28, 85/36, and 32/16 are calculated by determining the number of gear teeth in the gears of the gear train 92.

$$\Theta_{steer\ motor}=-(93/28)*\theta_{caster}$$

$$\Theta_{roll\ motor}=-(85/36)*\theta_{caster}+(85/36)*(32/16)*\theta_{wheel}$$

$\theta_{roll\ motor}$ angular position of the roll motor 90

$\theta_{wheel}$ angular position of the wheel 86

$\theta_{steer\ motor}$ angular position of the steer motor 88

$\theta_{caster}$ angular position of the caster 94

Lastly, eight motor signals are sent to the "motorout" block 154 that then sends the desired positions to the motion control processors 142 (FIG. 9). The eight "Target Scope" blocks 156 allow the motor signals to be displayed on the Target PC. This control framework allows for easy changes in the prototype control model.

After the algorithms are selected, the Simulink control model 144 should not change and may therefore run continuously in the target PC 140. Therefore, in the post algorithms selection model or when the control algorithms are known, the system may simply take the desired motion input from a joystick, a touch pad or one of the many other sensors discussed above and produces a desired rotation for the casters and for the wheels based on the established algorithms. In a passive system, the speed of the wheel will be sensed and will be braked appropriately to ensure that the wheel is damped, i.e., not feel icy.

To control the desired damping and stiffness of the traversable platform, a damping and stiffness equation based on the motor torque and the gear transmission ratio is derived. The damping in the plane of the traversable platform 12 should feel consistent in any planar direction, X, Y or theta. In the present embodiment, the damping and stiffness should be controlled so that when a user takes a step in any direction, the damping and stiffness should feel the same. Accordingly, a diagonal matrix with equal stiffness values in the X and Y directions are chosen. The Jacobian is used to calculate the needed torque transmitted by the wheels. If the wheels are current controlled, the desired torque values can be sent directly to the current controller with the gear ratios taken into account. A standard industry current controller can be used such as the Kollmorgen ServoStar™ controller. In a current controlled motor, the current may be adjusted, which is proportional to the torque of the motor by the standard torque constant, Kt. In this method, the caster and wheel position are not controlled, but the torque on both the caster and wheel are controlled.

The equation shown below computes the desired torque for the caster and the wheel based on the Jacobian, J, the stiffness matrix, K, and the wheel and caster velocities.

$$K=\begin{pmatrix} a & 0 \\ 0 & a \end{pmatrix}$$

$$\begin{pmatrix} \tau_{wheel} \\ \tau_{caster} \end{pmatrix}=J^T\begin{pmatrix} a & 0 \\ 0 & a \end{pmatrix}J\begin{pmatrix} \dot{\Theta}_{wheel} \\ \dot{\Theta}_{caster} \end{pmatrix}.$$

Here, a defines the stiffness value in Newton meters; $\theta_{caster}$ defines the orientation angle of the caster, and $\theta_{wheel}$ defines the rotation of the wheel. The stiffness of the treadmill can be adjusted by changing the value of "a". As is well known in the art, "a" is a stiffness coefficient in a standard stiffness matrix. The stiffness matrix is used to control the amount of force or torque that is applied for a particular deflection.

Although not shown, a control panel for controlling the ODT 10 may be used to turn the system on and off, similar to that of a standard one-directional treadmill. Depending on the desired sophistication of the ODT 10, a joystick or keypad may be incorporated with the control panel to allow the user to input the desired motion. Alternatively, the user may wear a harness so that the desired motion may be sensed. Other sensors described above may also be used with the ODT 10.

Exemplary usage of the ODT 10 include simple walking or jogging on the traversable platform 12, similar to using a standard one-directional treadmill. The ODT 10 may also be used in environments where a visual aid will be presented to the user for fun, exercise, military training, evacuation studies, perceptual studies, or language immersion studies, just to name a few. For example, in a rehabilitation environment, the system may be used to train and exercise people in natural walking, as opposed to just simple one-dimensional walking. The person to be rehabilitated may also be presented with a visual aid and simulated obstacles or settings for traversing through. The user may utilize the ODT 10 by stepping on the traversable platform 12 and face one or more control panels that are mounted proximately along the perimeter of the treadmill. The one or more control panels will allow the user to start and stop the system in case of an emergency or the user may be equipped with a wireless remote controller which may include on/off control function, program functions, etc.

The user may also be able to input pre-programmed walking patterns to the control system via the control panel or the wireless remote controller. The user's motion can be pre-programmed, but can also be sensed by a harness, or any one of the other sensors discussed above. The user will also have the choice of controlling the feel of the surface by choosing the desired stiffness of the surface.

Figure 11:
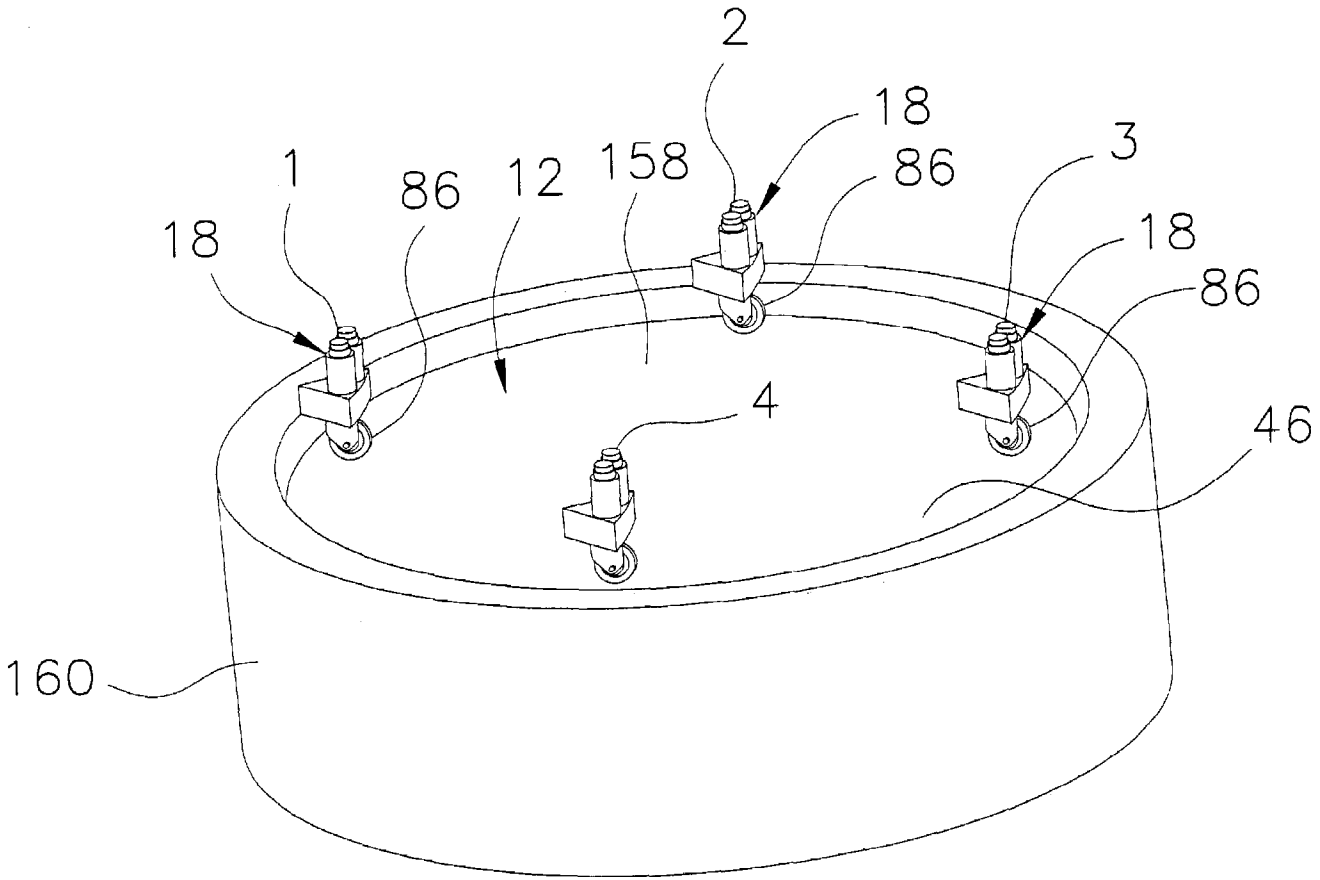
FIG. 11 is a semi-schematic perspective view of the ODT of FIG. 1 with the powered offset casters in a top-mounted position.

FIG. 11 is a semi-schematic perspective view of the ODT 10 provided in accordance to practice of the present invention with an alternative powered caster arrangement. As shown, four powered offset casters 18 are mounted such that the wheels contact with the traversable platform 12 on a first surface 158 of the platform, i.e., the same surface that is walked on by a user. This caster position will be referred to as a top-mounted position as opposed to a bottom-mounted position shown in FIG. 1. As further discussed below, support posts for each of the powered offset caster may be used to support the caster in the top-mounted position. The support posts may be attached to the base frame 14 via welding, fastening, riveting, etc.

The four casters, 1, 2, 3, and 4, when in the top-mounted position, may be configured so that they assist the belt 46 to remain in a stretched state. For example, assuming that a user is walking in the direction of the first powered offset caster 1, the first powered offset can be over sped by about 1% to about 5% over the roll or transmission speed of the second, third, and fourth casters, 2, 3, 4. Similarly, if the user is walking in between the first and second casters 1, 2, the first and second casters can both be over sped by about 1%-5% to keep the belt surface 158 stretched. The tension on the belt 46 may also be controlled by adjusting the vertical force applied by the wheel 86 on the belt surface 158. For example, the support posts may include adjustment mechanisms that enable the wheels to be adjusted up and down to adjust the force of the wheels on the belt surface. The adjustment mechanisms may include a threaded collar, a tensioning belt, adjustment detents, a ratchet system, pneumatic actuators, etc.

The ODT 10 is shown with side panels 160 attached to the base frame 14. The side panels 160 may include metal sheeting materials, plastic sheeting materials, or fabric attached together to form a layer or a shell around the base frame 14 (i.e., to hide the base frame for aesthetic appeal). The sheeting materials may also include markings (i.e., trademark, slogan, etc.), LCD display, electroluminescent lighting, or similar displays for product recognition and/or marketing.

Figure 12:
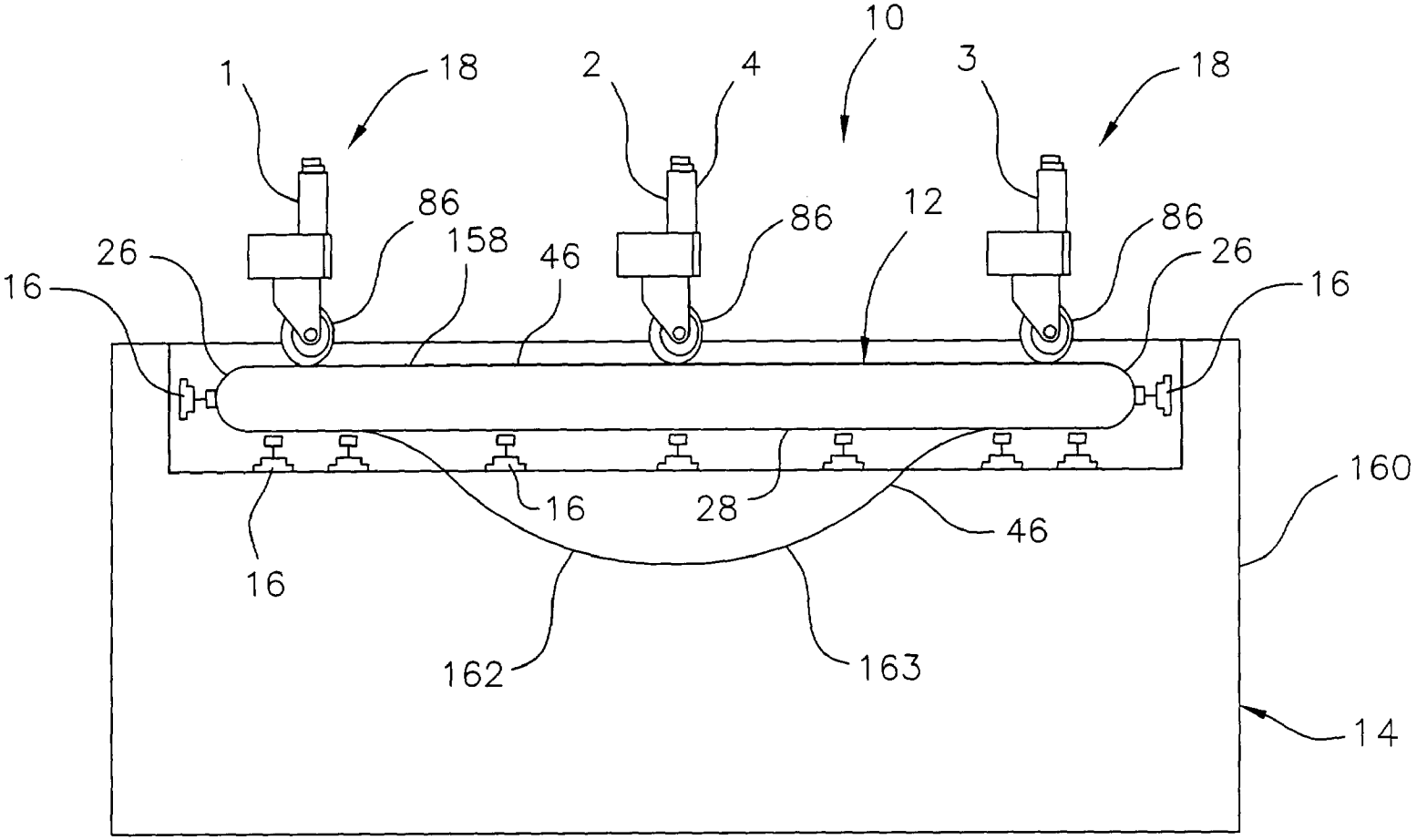
FIG. 12 is a semi-schematic partial side view of the ODT of FIG. 11.

FIG. 12 is a semi-schematic partial cross-sectional view of the ODT 10 of FIG. 11 provided in accordance with the practice of the present invention. As shown, the belt 46 may be stretched along the first surface 158 by controlling the wheel and angle position of the four casters 1, 2, 3, 4. The traversable platform 12 is supported along the belt perimeter 26 by a perimeter mounted set of spherical rollers 16', and along a second belt surface 162, along the perimeter edge of the second surface, by a set of bottom mounted spherical rollers 16 (See also, FIGS. 1 and 2). However, because of the top-mounted position of the powered offset casters, the belt 46 along the second surface 162 does not have to be stretched to conform to the shape of the platform frame 28, although the belt may be constructed in the same manner as that shown in FIG. 1. This is because for a given point on the belt 46, as that point travels from the lower un-stretched or relaxed surface 162 to the upper surface 158, that point on the belt will be in tension when it falls within the area defined by the four powered offset casters. The tensioned belt is due to the planar force applied by the casters on the belt and not necessarily due to any stretch characteristics of the belt, as discussed above with reference to the belt of FIG. 1. Accordingly, the second surface 162 of the belt 46 may be allowed to droop or sag 163 within the central area of the base frame 14 when the casters are in the top-mounted position and still be dampenable and adjustable by the casters.

Although not shown, the powered offset casters 1, 2, 3, 4 may also be side-mounted and may impart motion to the traversable platform 12 via the side perimeter 26 of the platform. The casters 1, 2, 3, 4 may be mounted sideways by anchoring the casters to the base frame and pointing the wheels 86 sideways so that they contact the belt 46 via the side perimeter 26 of the traversable platform. The casters may also be fitted with tensioning brackets to adjust the amount of contact force of the wheels 86 on the belt 46.

Figure 13:
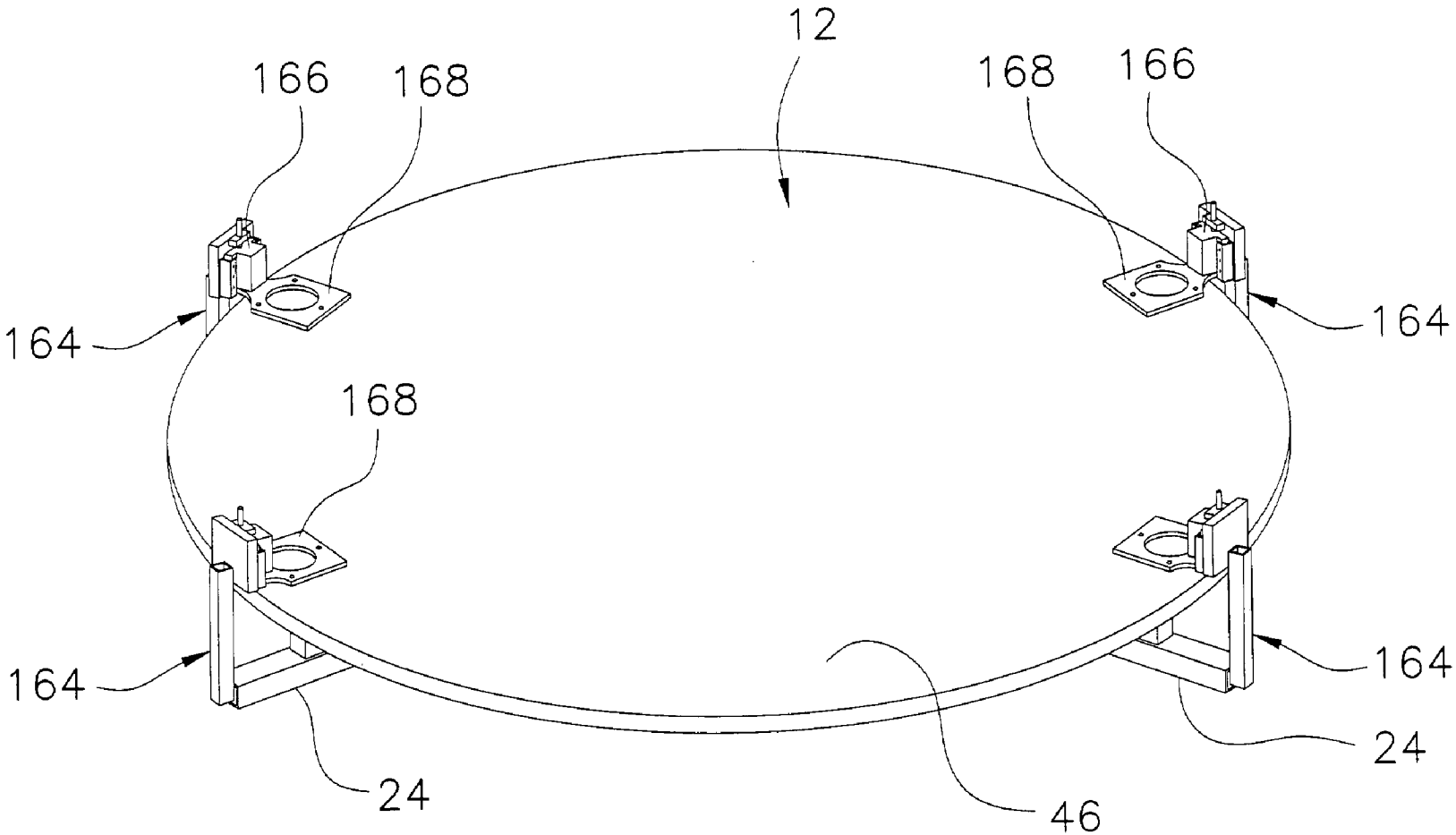
FIG. 13 is a semi-schematic partial perspective view of the ODT of FIG. 11 with just the traversable belt and the support posts.

FIG. 13 is a semi-schematic perspective view of the traversable platform 12 and four support posts 164. The support posts 164 are each attached to an extension arm 24, which extends radially from the base frame 14. The support posts 164 may be similarly constructed as the extension arms 24 provided for the restraining walls 21 (FIG. 1). The support posts 164 are each provided with a tensioning bracket 166 for raising or lowering the powered offset caster to adjust for the amount of force applied on the belt 46 by the wheel 86. The tensioning bracket 166 may comprise any number of adjustable mechanisms such as a rack and pinion arrangement, a pin and slot arrangement, detents, threaded collar, or any other known conventional mechanisms for making height adjustments. Additionally, the tensioning bracket 166 may include a motor and gear arrangement for automatic adjustment or compensation when the speed and angular adjustment of the wheel and caster are not sufficient. The support posts 164 are also shown with caster mounting brackets 168. The caster mounting brackets 168 may comprise a flange, a two-part clamp, or a plate for mechanically receiving the powered offset casters 18.

Although the preferred embodiments of the invention have been described with some specificity, the description and drawings set forth herein are not intended to be delimiting, and persons of ordinary skill in the art will understand that various modifications may be made to the embodiments discussed herein without departing from the scope of the invention, and all such changes and modifications are intended to be encompassed within the appended claims. Various changes to the ODT may be made including manufacturing the dimensions differently, using different materials, changing the interface devices in between the various components, etc. For example, instead of using metal tubing to make the base frame and the platform frame, carbon fiber is used. Other changes may include using different belt materials, forming the base using only fasteners, changing the gearing arrangements of the powered offset casters, using a different motion-control processor, using offset casters along the perimeter of the base to support the traversable platform, using a flat walking surface instead of a belt (such as a sheet of wood), using replicating parts such as circular or horizontal tiles instead of a belt and then providing means to feed the replicating parts over the traversable platform and means for returning the replicating parts back to the feed means, and using a different software. The means for feeding and for returning can comprise of motorized components and can include belts, chains, and gears. The traversable platform can also be substituted by a large spherical ball and the spherical ball rotated by the powered offset casters contacting with the outside surface of the ball. Non-motorized offset casters may also be used to support the spherical ball structure. The large spherical ball can be traversed over by a user via the outside of the ball or the inside of the ball, and due to a sufficient radius, natural walking in the plane can be achieved. The ball can also rotate about three independent directions. Accordingly, many alterations and modifications may be made by those having ordinary skill in the art without deviating from the spirit and scope of the invention.

The programming code for the control system discussed herein is attached as a computer program listing appendix and is attached via a CD-Rom, in identical duplicate copies as Copy 1 and Copy 2. The computer program listing appendix is hereby incorporated herein by reference and the specific files, including the names, sizes, and date of creation are specified in the transmittal sheet for the CD-Rom. A separate hardcopy of the program code is also attached hereto with the computer program listing appendix and is also hereby incorporated herein by reference.

What is claimed is:

1. An Omni-directional treadmill comprising a traversable platform mounted on a base, the traversable platform comprising a platform frame and a belt stretched in-part over the platform frame, two powered offset casters each comprising a roll motor for imparting rotational motion to the wheel, and a control system;

wherein the wheels of each powered offset casters are in contact with the belt;

wherein the damping and stiffness of the traversable platform is controlled by controlling the translational motion of the powered offset casters; and wherein the two powered offset casters comprise a translational motion that is controllable by the control system.

2. The Omni-directional treadmill of claim 1, wherein the powered offset casters comprise an angular rotation and wherein the angular rotation is determined by a force applied on the belt by a user.

3. The Omni-directional treadmill of claim 1, further comprising a plurality of Omni-directional wheels attached to the platform frame.

4. The Omni-directional treadmill of claim 3, further comprising two sheets of material positioned in between the platform frame and the belt.

5. The Omni-directional treadmill of claim 1, wherein the base comprises a lower base frame and an upper base rim, and wherein the base rim comprises a first set of spherical rollers mounted along a first plane and a second set of spherical rollers mounted along a second plane.

6. The Omni-directional treadmill of claim 5, wherein the traversable platform comprises a first traversable surface, a second traversable surface, and a traversable perimeter, and wherein the second traversable surface is in contact with the spherical rollers mounted along the first plane and the traversable perimeter is in contact with the spherical rollers mounted along the second plane.

7. The Omni-directional treadmill of claim 1, wherein the powered offset casters each further comprises a steer motor and an angular motion and wherein the control system is adapted to control the roll motor and the steer motor to move the belt in a X, Y, or theta direction relative to a fixed point located on the belt.

8. The Omni-directional treadmill of claim 7, wherein the control system is adapted to control a damping motion of the belt by controlling the angular motion and translational motion of the powered offset tasters, by adjusting the torque on the steer and roll motors of the powered offset caster, or b, adjusting the torque on a steering axis and a roll axis of the powered offset casters.

9. The Omni-directional treadmill of claim 8, wherein the control system uses rapid embedded programming to send and receive signals from and to a motion-control processor electrically coupled to each of the powered offset caster.

* * * * *